US009117598B2

(12) United States Patent
Heins et al.

(10) Patent No.: US 9,117,598 B2
(45) Date of Patent: Aug. 25, 2015

(54) LATCHING DEVICE FOR A CIRCUIT BREAKER

(75) Inventors: Volker Heins, Rheinbach (DE); Detlef Koch, Cologne (DE); Gregor Fleitmann, Kerpen (DE); Hans-Juergen Mader, Dieblich (DE); Wolfgang Kutsche, Weilerswist (DE)

(73) Assignee: EATON ELECTRICAL IP GMBH & CO. KG, Schoenefeld (DE), `

( * ) Notice: Subject to any disclaimer, the term of this patent is extended or adjusted under 35 U.S.C. 154(b) by 105 days.

(21) Appl. No.: 13/989,803

(22) PCT Filed: Nov. 29, 2011

(86) PCT No.: PCT/EP2011/071317

§ 371 (c)(1),
(2), (4) Date: Jun. 18, 2013

(87) PCT Pub. No.: WO2012/072647

PCT Pub. Date: Jun. 7, 2012

(65) Prior Publication Data

US 2013/0306453 A1 Nov. 21, 2013

(30) Foreign Application Priority Data

Nov. 29, 2010 (EP) ..... 10193011

(51) Int. Cl.
*H01H 5/00* (2006.01)
*H01H 5/10* (2006.01)
(Continued)

(52) U.S. Cl.
CPC . *H01H 5/10* (2013.01); *H01H 1/52* (2013.01); *H01H 71/505* (2013.01); *H01H 2071/565* (2013.01)

(58) Field of Classification Search
CPC . H01H 2071/565; H01H 5/10; H01H 71/505; H01H 1/52
USPC ..... 200/468, 400–401, 303, 330–331, 200/332.1, 337
See application file for complete search history.

(56) References Cited

U.S. PATENT DOCUMENTS 5,082,996 A * 1/1992 Takahashi et al. ..... 200/401
5,504,290 A 4/1996 Baginski et al.
(Continued)

FOREIGN PATENT DOCUMENTS

CN 1095185 A 11/1994
CN 1567504 A 1/2005
(Continued)

*Primary Examiner* — Edwin A. Leon
(74) *Attorney, Agent, or Firm* — Leydig, Voit & Mayer, Ltd.

(57) ABSTRACT

A latching device for a circuit breaker includes a manual operating toggle moveably arranged between an OFF-position and an operation-readiness position, a moveable contact and a fixed contact, wherein the moveable contact is configured to open and close a main circuit of the circuit breaker. An energy storage mechanism is configured to store an actuating force of the toggle by the toggle being moved from the OFF-position to the operation-readiness position and to exert the stored force to the moveable contact to close the main circuit of the circuit breaker. A removable retention lever is configured to prevent movement of the moveable contact into a closing position upon the energy storage mechanism exerting the stored force to the moveable contact. A holding mechanism is configured to hold the toggle in the operation-readiness position.

15 Claims, 3 Drawing Sheets

(51) Int. Cl.

| | |
|---|---|
| ***H01H 1/52*** | (2006.01) |
| ***H01H 71/50*** | (2006.01) |
| *H01H 71/56* | (2006.01) |

(56) References Cited

U.S. PATENT DOCUMENTS

| | | | | |
|---|---|---|---|---|
| 5,517,164 | A | 5/1996 | Zoller et al. | |
| 7,956,307 | B2 * | 6/2011 | Ahn | 218/154 |
| 8,420,968 | B2 * | 4/2013 | Park | 200/335 |
| 2009/0189717 | A1 | 7/2009 | Hung et al. | |
| 2009/0189719 | A1 | 7/2009 | Yang | |

FOREIGN PATENT DOCUMENTS

| | | | |
|---|---|---|---|
| GB | 2172146 | A | 9/1986 |
| JP | 62097225 | A | 10/1988 |
| JP | 2003151422 | A | 5/2003 |

* cited by examiner

LATCHING DEVICE FOR A CIRCUIT BREAKER

CROSS-REFERENCE TO PRIOR APPLICATIONS

This application is a U.S. National Phase application under 35 U.S.C. §371 of International Application No. PCT/EP2011/071317, filed on Nov. 29, 2011, and claims benefit to European Patent Application No. EP 10193011.3, filed on Nov. 29, 2010. The International Application was published in English on Jun. 7, 2010 as WO 2012/072647 A1 under PCT Article 21(2).

FIELD

The invention relates to a latching device for a circuit breaker.

BACKGROUND

Remote-control releases are known to remotely switching a circuit breaker on or off. The known remote-control release is often mounted on a standard circuit breaker and is operatively connected with the lever of said circuit breaker. The remote-control release comprising an electrical device which is adapted to move via a mechanical component a toggle of the circuit breaker into the ON- or OFF-position. To switch-on a circuit breaker by a remote-control release, an operator has to start the electrical device, which could be a motor by closing an electrical contact from the distance.

The mechanical component of the known remote-control release comprises a spring-operating storage, wherein the spring-operating storage of the remote-control release is adapted to clamp a spring-operating storage of the latching device such that the toggle of the latching device of the circuit breaker is moved above a breakover point. If the toggle of the latching device is moved above said breakover point, the spring-operating storage of the latching device is released and the contacts of the circuit breaker are moved by the latching device into a close position.

The functionality of the spring-operating storage is available in the latching device of the circuit breaker and in the remote-control release. The remote-control release is composed by a lot of components, which causes high assembly costs. The chain of operation comprises complicate mechanical operation sequences so that the probability of a loss in the remote-control release increases.

SUMMARY

In an embodiment, the present invention comprises a latching device for a circuit breaker. A manual operating toggle is moveably arranged between an OFF-position and an operation-readiness position. The latching device includes a moveable contact and a fixed contact, wherein the moveable contact is configured to open and close a main circuit of the circuit breaker. An energy storage mechanism is configured to store an actuating force of the toggle by the toggle being moved from the OFF-position to the operation-readiness position and to exert the stored force to the moveable contact to close the main circuit of the circuit breaker. A removable retention lever is configured to prevent movement of the moveable contact into a closing position upon the energy storage mechanism exerting the stored force to the moveable contact. A holding mechanism is configured to hold the toggle in the operation-readiness position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
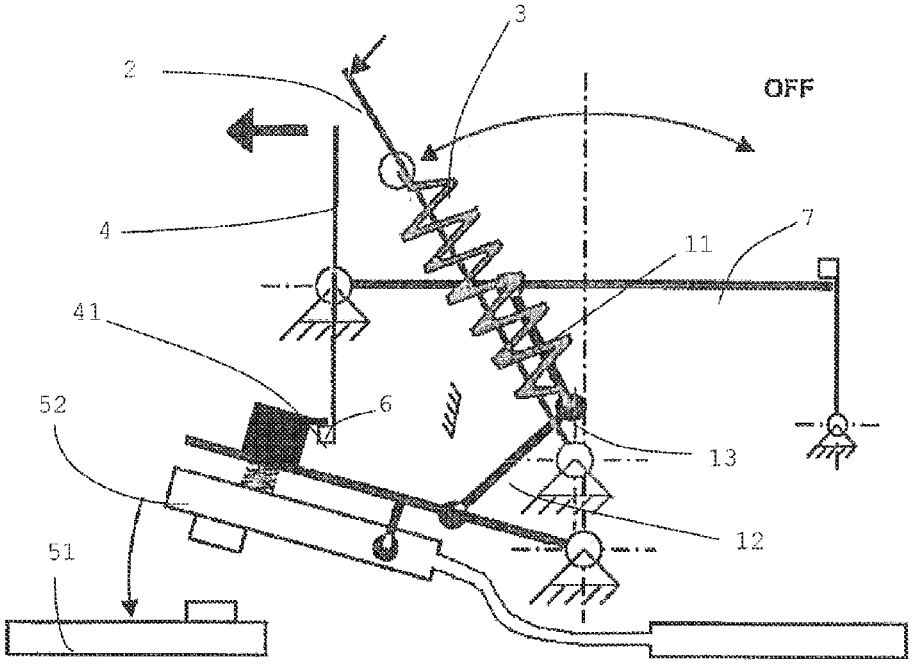
FIG. 1 shows a schematic depiction of an embodiment of a latching device.

In an embodiment, the invention simplifies the operation of a circuit breaker by a remote-control release.

In an embodiment, the present invention provides a latching device for a circuit breaker comprising a manual operating toggle which is moveably arranged between an OFF-position and an operation-readiness position. The latching device further comprises a moveable contact and a fixed contact, wherein the moveable contact is adapted to open and close the main circuit of the circuit breaker. Further the latching device comprises an energy storage mechanism which stores an actuating force of the toggle when the toggle is moved from the OFF-position to the operation-readiness position and is adapted to exert the stored force to the moveable contact to close the main circuit of the circuit breaker. The invention is characterized in that the latching device further comprises a removable retention lever for preventing the movement of the moveable contact into a closing position if the energy storage mechanism exerts the stored force to the moveable contact (52).

The advantage is that the circuit breaker can be easily switched on remotely by moving the retention lever and releasing the movable contact. This can be done from far distance by activating e.g. an electrical motor to move the retention lever.

Further the energy storage mechanism comprises a bell-crank lever comprising a first and a second arm which are pivotably linked at a fulcrum pin, wherein the free end of the first arm of the bell-crank lever is pivotably connected to a support lever defining a breakover-point for the toggle and the free end of the second arm of the bell-crank lever is pivotably connected to a movable contact of the circuit breaker and wherein the fulcrum pin is operatively connected via a spring with the manually-operative toggle such that the spring contracting the bell-crank lever if the toggle is moved above the breakover-point into the operation-readiness position and pushing apart the bell-crank lever if the toggle is moved into the OFF-position.

According to an embodiment of the invention, a holding mechanism is provided which holds the toggle in the operation-readiness position.

Such holding mechanism can be at least partly provided by the energy storage mechanism such that based on the design of the components of the mechanism the toggle is held in the operation-readiness position once the toggle is moved into this position.

In a further embodiment, the energy storage mechanism is part of a linear actuator which is operatively connected to the moveable contact of the circuit breaker.

In a further embodiment, the retention lever having a first end and a second end disposed in a substantial distance from one another, the second end of the retention lever is operatively connected with an actor in such a way to enable the first end to release the moveable contact. In a further embodiment the retention lever blocks the movement of the fulcrum pin if the toggle is in an operative-readiness position. In a further embodiment, the first end comprises a detent which is operatively connected with a protrusion of the moveable contact if the toggle is in an operation-readiness position. In a further embodiment, the first end comprises a protrusion which is operatively connected with a detent of the moveable contact if the toggle is in an operation-readiness position. The retention lever can be build up very easy without complex mechanical means. Therefore it is cheap and easy to handle. The actor can be any kind of electrical or electronic means such as a motor. The actor can also be a bowden cable or any other flexible cable which can pass a mechanical action over a long distance to the retention lever. Advantageously, the first end of the retention lever comprises a hook which is operatively connected with a protrusion of the moveable contact if the toggle is in an operation-readiness position.

The invention further provides in an embodiment a remote-control release for a latching device of a circuit breaker according to any of the prescribed embodiments, wherein the remote-control release comprising a rotatably mounted control curve which is operatively connected to the toggle of the latching device via a first contact point such that a rotating of the control curve results in a movement of the toggle from an OFF-position to an operation-readiness position. This remote-control release does not contain any spring-operating storage. Therefore the remote-control release is easy to assemble and contains less mechanical parts than the remote-control releases in the state of the art. The spring-operating storage is only available in the circuit breaker.

In a further embodiment, the remote-control release comprises a first actuating lever which is rotatably mounted with a first end on a fixed mounting point and which is releasably connected to the toggle of the latching device with a second end, and wherein the first actuating lever comprises the first contact point to the control curve between the first and the second end. It is possible to remove the remote-control release from the circuit breaker. Therefore the circuit breaker can be used without any changes autonomously.

In a further embodiment of the removable remote-control release, a second actuating lever is rotatably mounted on the fixed mounting point in a fixed angle to the first actuating lever, wherein the first and the second actuating lever are coupled in a V-shape form, and wherein the second actuating lever comprises a second contact point to the control curve such that a rotating of the control curve results in a movement of the toggle from an operation-readiness position to an OFF-position. In this advantageously embodiment the remote-control release is also adapted to switch-OFF a circuit breaker remotely.

In a further embodiment, the remote-control release comprises a further lever arm with a second contact point to the control curve, which is connected to the toggle and wherein a rotating of the control curve results in a movement of the toggle from an operation-readiness position to an OFF-position. This remote-control release is linked to the circuit breaker to build-up a compact circuit breaker with a build-in remote-control release. This circuit breaker can be switched to the operation-readiness position and to the OFF-position by the build-in remote-control release.

Advantageously, the rotatably mounted control curve is powered by an electrical motor. Therefore it is easy to remotely control the circuit breaker by switching the motor on and off.

The invention further provides in an embodiment a latching system comprising the latching device according to any of the prescribed embodiments and the remote control release according to any of the prescribed embodiments.

The invention further includes, in an embodiment, a method of operating the latching device of a circuit breaker according to any of the prescribed embodiments, wherein the method comprises the steps of moving the toggle into the operation-readiness state by the remote control release and tripping the actor of the latching device to release the moveable contact of the circuit breaker such that the contacts are closed.

FIG. 1 discloses an embodiment of an inventive latching device of a circuit breaker. The latching device comprises a manual operating toggle 2, which is rotatably mounted at a fixed mounting point. The toggle 2 is manually moveable between an OFF-position and an operation-readiness position. The latching device further comprises a bell-crank lever which is operatively connected to the toggle 2. The bell-crank lever comprises two bell-crank lever arms 11, 12 which are moveably connected at a fulcrum pin 13 of the bell-crank lever. The fulcrum pin 13 is linked with the toggle 2 by a spring 3. The free end of the first arm 11 of the bell-crank lever is moveably connected to a support lever 7. The free end of the second arm 12 of the bell-crank lever is moveably connected to a moveable contact 52 of the circuit breaker.

If the toggle 2 is in the OFF-position, the spring contracts both arms 11, 12 of the bell-crank lever such that the moveable contact 52 does not touch the fixed contact 51 of the circuit breaker. The extension spring 3 can also be a compression spring. Therefore, the bell-crank lever has to be turned over. If the toggle 2 is moved into the direction of the operation-readiness position, the angle between the first arm 11 of the bell-crank lever and the toggle 2 decreases until the arm 11 is pointing into the same direction as the toggle 2. The toggle has then reached the breakover-point of the bell-crank lever. If the toggle 2 is moved further into the operation-readiness position, the spring 3 pushing apart the arms 11, 12 of the bell-crank lever such that the moveable contact 52 moves into the closing position.

Before the moveable contact 52 comes into contact with the fixed contact 51, a retention lever 4 prevents a further movement of the moveable contact 52 in the direction of the fixed contact 51. The spring 3 expands and the toggle 2 reaches the operation-readiness position. The spring can now execute an increased force to the bell-crank lever to push apart both arms 11, 12 for closing the contacts 51, 52.

The retention lever 4 is rotatably mounted on a fixed mounting point and comprises a first and a second end. The first end of the retention lever 4 comprises a hook 41 which gets stuck with a protrusion 6 of the moveable contact 52 such that the moveable contact 52 is not able to move any further into the direction of the fixed contact 51. It is also possible that an electromagnet is mounted at the first end of the retention lever 4. A piece of metal is mounted at the moveable contact 52 on the opposite side of the electromagnet. To release the retention lever 4, the electromagnet can be switched off to release the metal part.

The second end of the retention lever 4 is connected with an actor. The actor can also be a bowden cable or bowden wire or any other flexible cable which can pass a mechanical action over a long distance to the retention lever. The actor can also be an electrical motor which is adapted to move the retention lever 4.

Figure 2:
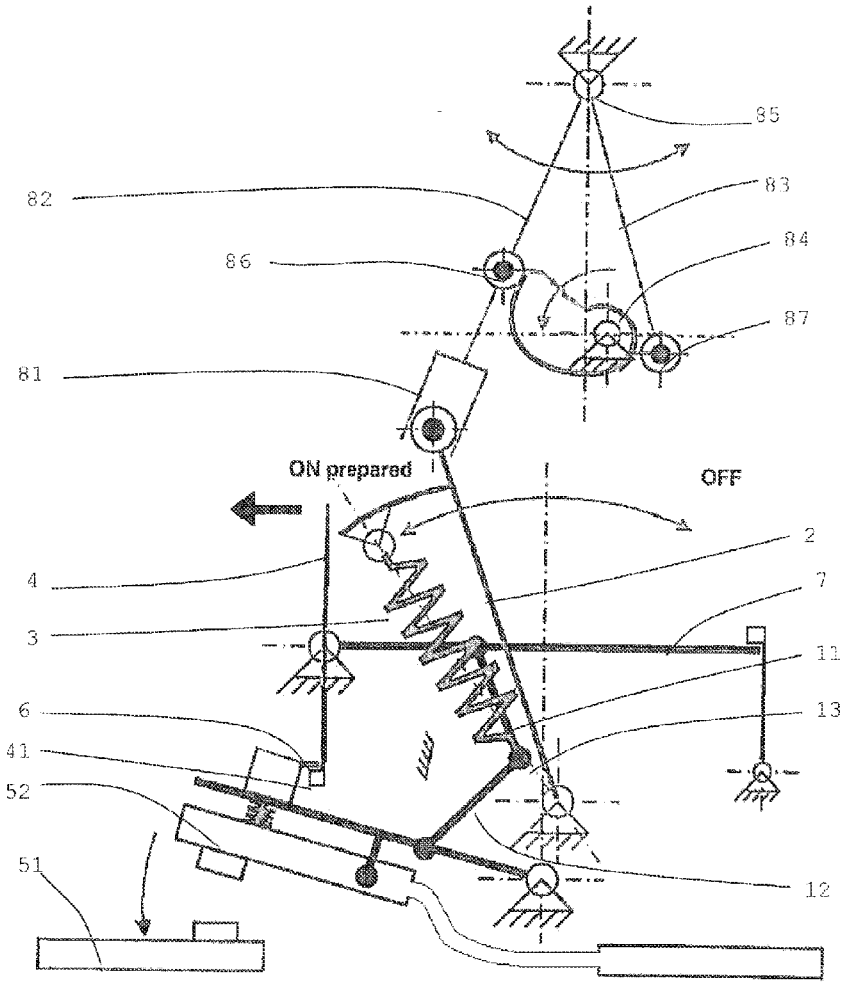
FIG. 2 shows a schematic depiction of an embodiment of a latching device and a remote-control release.
Figure 3:
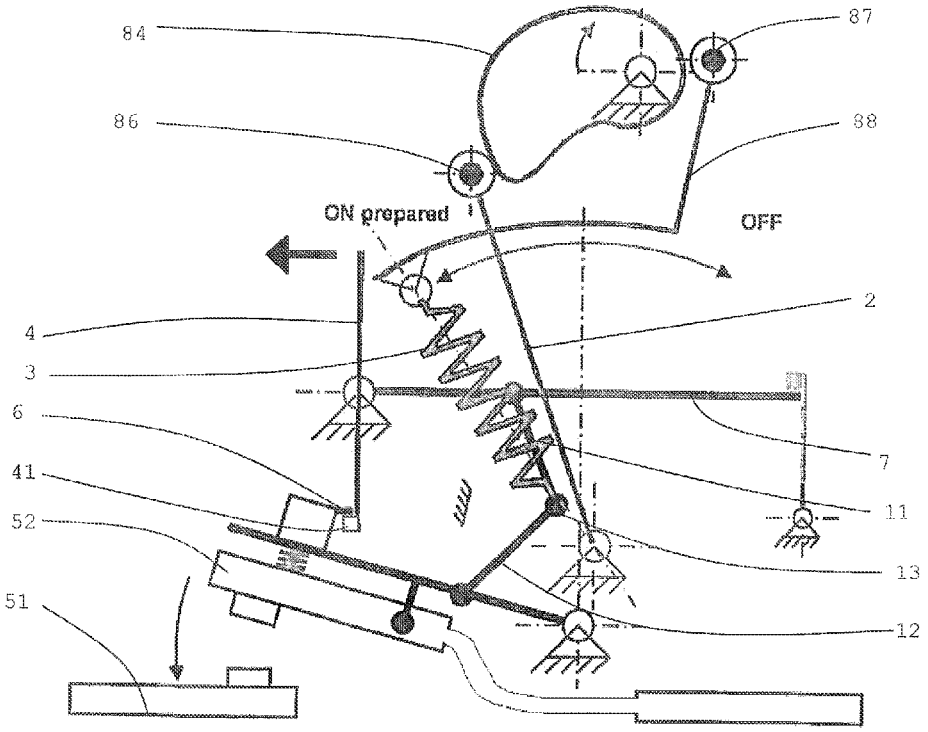
FIG. 3 shows a schematic depiction of an embodiment of a latching device and a further remote-control release.

FIGS. 2 and 3 depict a remote-control release which works together with the prescribed latching device. FIG. 2 depicts a removable remote-control release whereas FIG. 3 depicts an integrated remote-control release. Both embodiments of the inventive remote-control releases comprise a rotatable control curve 84. The rotation of this control curve 84 can be performed by an electrical device, e.g. a motor, which can be controlled from a far distance by electronic means. The control curve 84 is operatively connected to the toggle 2 of the circuit breaker such that if the control curve 84 rotates, the toggle 2 moves from the OFF-position into the operation-readiness position by following the curve of the control curve 84. Therefore, a first contact point 86 is established between the control curve 84 and the toggle 2 in FIG. 3.

In FIG. 2, a first actuating lever 82 is in contact via the first contact point 86 with the control curve 84. The first actuating lever 82 is operatively connected with the toggle 2 via a reception 81. The remote-control release is therefore removably mounted on the circuit breaker. The first actuating lever 82 is moveably mounted on a fixed mounting point 85 and transmits its moving to the toggle 2. A second actuating lever 83 is moveably mounted on the same fixed mounting point 85 such that both actuating levers 82, 83 are coupled in a V-shape form. The angle between both actuating lever 83, 84 is fixed. The second actuating lever 83 provides a second contact point 87 which is in contact with the control curve 84. If the control curve 84 rotates in a specified direction, the second actuating lever 83 moves. Because both actuating lever 82, 83 are connected together, the first actuating lever 82 also moves the toggle 2 of the circuit breaker into the OFF-position.

In a summary, the control curve 84 moves the first actuating lever 82 via the first contact point 86 to move the toggle 2 into the operation-readiness position. The control curve 84 moves the second actuating lever 83 via the second contact point 87 to move the toggle 2 into the OFF-position. The form of the control curve 84 is in a peanut-form and is rotatably mounted out of the geometrical center.

FIG. 3 shows a similar method of moving the toggle 2 in both directions. Because in this embodiment, the remote-control release is included in the circuit breaker, a lever arm 88 is connected to the toggle 2 and takes over the function of the second actuating lever 83 of FIG. 2. The second contact point 87 is attached on the free end of the lever arm and is also operatively connected to the control curve 84. The first contact point 86 is directly attached to the toggle 2.

According to a preferred embodiment, a holding mechanism is provided for holding the toggle (2) in the operation-readiness position. The holding mechanism can be provided by an adequate lever mechanism, e.g. by adequate design of the bell-crank lever and/or adequate positioning of the pins such that the toggle reaches a stable position when moved into the operation-readiness position (like in FIG. 1) Other possible embodiments include compulsory guides and/or restraints to stabilize and/or hold the toggle (2) in its operation-readiness position. According to a preferred embodiment the toggle (2) is held in position operatively by an actuation mechanism e.g. the control curve, if necessary via one or more levers. Such embodiments are exemplary shown in FIG. 2 and FIG. 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

LIST OF REFERENCE NUMERALS

11 first arm of a bell-crank lever
12 second arm of a bell-crank lever
13 fulcrum pin of a bell-crank lever
2 manual operating toggle
3 spring
4 retention lever
41 hook
51 fixed contact
52 moveable contact
6 protrusion
7 support lever
81 reception
82 first actuating lever
83 second actuating lever
84 control curve
85 mounting point
86 first contact point
87 second contact point
88 lever arm

The invention claimed is:

1. A latching device for a circuit breaker, comprising:

a manual operating toggle moveably arranged between an OFF-position and an operation-readiness position;

a moveable contact and a fixed contact, wherein the moveable contact is configured to open and close a main circuit of the circuit breaker;

an energy storage mechanism configured to store an actuating force of the toggle by the toggle being moved from the OFF-position to the operation-readiness position and to exert the stored force to the moveable contact to close the main circuit of the circuit breaker;

a removable retention lever configured to prevent movement of the moveable contact into a closing position upon the energy storage mechanism exerting the stored force to the moveable contact; and a holding mechanism configured to hold the toggle in the operation-readiness position.

2. The latching device according to claim 1, wherein the energy storage mechanism includes a bell-crank lever having a first arm and a second arm that are pivotably linked at a fulcrum pin, a free end of the first arm of the bell-crank lever being pivotably connected to a support lever defining a breakover-point for the toggle and a free end of the second arm of the bell-crank lever being pivotably connected to the movable contact, the fulcrum pin being operatively connected via a spring with the toggle such that the spring contracts the bell-crank lever upon the toggle being moved above the breakover-point into the operation-readiness position and pushes apart the bell-crank lever upon the toggle being moved into the OFF-position.

3. The latching device according to claim 1, wherein the energy storage mechanism is part of a linear actuator which is operatively connected to the moveable contact.

4. The latching device according to claim 1, wherein a first end and a second end of the retention lever are disposed a substantial distance from one another, the second end of the retention lever being operatively connected with an actor so as to enable the first end to release the moveable contact.

5. The latching device according to claim 4, wherein the first end includes a hook configured to be operatively connected with a protrusion of the moveable contact in the operation-readiness position of the toggle.

6. The latching device according to claim 4, wherein the energy storage mechanism includes a bell-crank lever having a first arm and a second arm that are pivotably linked at a fulcrum pin, and wherein the retention lever is configured to block movement of at least one of the fulcrum pin and the second arm of a bell-crank lever in the operation-readiness position of the toggle.

7. The latching device according to claim 4, wherein the first end includes a detent configured to be operatively connected with a protrusion of the moveable contact in the operation-readiness position of the toggle.

8. The latching device according to claim 4, wherein the first end includes a protrusion configured to be operatively connected with a protrusion of the moveable contact in the operation-readiness position of the toggle.

9. A remote-control release for a latching device comprising: a manual operating toggle moveably arranged between an OFF-position and an operation-readiness position; a moveable contact and a fixed contact, wherein the moveable contact is configured to open and close a main circuit of the circuit breaker an energy storage mechanism configured to store an actuating force of the toggle by the toggle being moved from the OFF-position to the operation-readiness position and to exert the stored force to the moveable contact to close the main circuit of the circuit breaker, a removable retention lever configured to prevent movement of the moveable contact into a closing position upon the energy storage mechanism exerting the stored force to the moveable contact; and a holding mechanism configured to hold the toggle in the operation-readiness position, the remote control release comprising:

a rotatably mounted control curve operatively connected to the toggle of the latching device via a first contact point such that a rotating of the control curve results in a movement of the toggle from an OFF-position to an operation-readiness position.

10. The remote-control release according to claim 9, further comprising a first actuating lever rotatably mounted at a first end on a fixed mounting point and releasably connected to the toggle at a second end, the first actuating lever including the first contact point to the control curve between the first end and the second end.

11. The remote-control release according to claim 10, further comprising a second actuating lever rotatably mounted on the fixed mounting point in a fixed angle to the first actuating lever, the first and the second actuating levers being coupled to each other in a V-shape form, the second actuating lever including a second contact point to the control curve such that a rotating of the control curve results in a movement of the toggle from the operation-readiness position to the OFF-position.

12. The remote-control release according to claim 9, further comprising a lever arm with a second contact point to the control curve, which is connected to the toggle, wherein a rotating of the control curve results in a movement of the toggle from the operation-readiness position to the OFF-position.

13. The remote-control release according to claim 9, wherein the rotatably mounted control curve is powered by an electrical motor.

14. A latching system comprising:

a latching device for a circuit breaker, comprising:

a manual operating toggle moveably arranged between an OFF-position and an operation-readiness position;

a moveable contact and a fixed contact, wherein the moveable contact is configured to open and close a main circuit of the circuit breaker;

an energy storage mechanism configured to store an actuating force of the toggle by the toggle being moved from the OFF-position to the operation-readiness position and to exert the stored force to the moveable contact to close the main circuit of the circuit breaker;

a removable retention lever configured to prevent movement of the moveable contact into a closing position upon the energy storage mechanism exerting the stored force to the moveable contact; and a holding mechanism configured to hold the toggle in the operation-readiness position, and a remote-control release for the latching device comprising:

a rotatably mounted control curve operatively connected to the toggle via a first contact point such that a rotating of the control curve results in a movement of the toggle from the OFF-position to the operation-readiness position.

15. A method of operating a latching system for a circuit breaker, the latching system comprising:

a manual operating toggle moveably arranged between an OFF-position and an operation-readiness position;

a moveable contact and a fixed contact, wherein the moveable contact is configured to open and close a main circuit of the circuit breaker;

an energy storage mechanism configured to store an actuating force of the toggle by the toggle being moved from the OFF-position to the operation-readiness position and to exert the stored force to the moveable contact to close the main circuit of the circuit breaker; and a removable retention lever configured to prevent movement of the moveable contact into a closing position upon the energy storage mechanism exerting the stored force to the moveable contact; and a holding mechanism configured to hold the toggle in the operation-readiness position, and a remote-control release for the latching device comprising:

a rotatably mounted control curve operatively connected to the toggle via a first contact point such that a rotating of the control curve results in a movement of the toggle from the OFF-position to the operation-readiness position, the method comprising:

moving the toggle into an operation-readiness state by the remote-control release; and tripping an actor of the latching device so as to release the moveable contact of the circuit breaker and close the moveable contact to the fixed contact.

* * * * *